US006383571B1

(12) United States Patent
Mühlfriedel

(10) Patent No.: US 6,383,571 B1
(45) Date of Patent: May 7, 2002

(54) DEVICE AND METHOD FOR COATING A FLAT SUBSTRATE

(75) Inventor: Eberhard Mühlfriedel, Steige (FR)

(73) Assignee: Guardian Industries Corp., Auburn Hills, MI (US)

( * ) Notice: Subject to any disclaimer, the term of this patent is extended or adjusted under 35 U.S.C. 154(b) by 0 days.

(21) Appl. No.: 09/466,584

(22) Filed: Dec. 17, 1999

(30) Foreign Application Priority Data

Dec. 17, 1998 (CH) ..... 2496/98

(51) Int. Cl.[7] ..... B05D 1/30; B05C 5/00; B05C 11/10

(52) U.S. Cl. ..... 427/420; 427/345; 427/356; 118/407; 118/429; 118/602; 118/DIG. 4

(58) Field of Search ..... 427/356, 420, 427/345; 118/410, 429, 602, 407, DIG. 4

(56) References Cited

U.S. PATENT DOCUMENTS

| | | | | |
|---|---|---|---|---|
| 3,894,511 A | * | 7/1975 | Armour et al. | 118/429 |
| 4,445,458 A | | 5/1984 | O'Brien | |
| 4,485,387 A | | 11/1984 | Drumheller | |
| 4,489,671 A | | 12/1984 | Choinski | |
| 4,605,573 A | | 8/1986 | Deeg et al. | |
| 4,907,530 A | | 3/1990 | Shibata et al. | |
| 4,938,994 A | | 7/1990 | Choinski | |
| 5,455,062 A | | 10/1995 | Muhlfriedal et al. | |
| 5,498,289 A | | 3/1996 | Itagaki | |
| 5,516,545 A | * | 5/1996 | Sandock | 427/209 |
| 5,622,747 A | * | 4/1997 | Todd et al. | 427/96 |
| 5,650,196 A | | 7/1997 | Mulfriedel | 427/240 |
| 5,871,585 A | * | 2/1999 | Most et al. | 118/410 |
| 5,989,621 A | | 11/1999 | Lichkus et al. | |

FOREIGN PATENT DOCUMENTS

| | | |
|---|---|---|
| JP | 2-277571 | * 11/1990 |
| WO | WO94/25177 | 11/1994 |

* cited by examiner

*Primary Examiner*—Katherine A. Bareford
(74) *Attorney, Agent, or Firm*—Nixon & Vanderhye P.C.

(57) ABSTRACT

A device for providing a coating on a surface includes a capillary slot that is open at the bottom and is filled via a supply chamber with coating medium. A substrate is conducted below the opening of the slot with the surface to be coated facing up. The capillary slot is not only determined by the intermolecular binding forces but can be actively fixed. As a result, high coating rates, e.g., between 30 and 100 mm/s, can be achieved. An especially reliable filling of the coating chamber results by providing an overflow container that communicates via a gravity-feed line with the capillary slot. The overflow container is preferably mounted so that it can be adjusted in height above the capillary slot, thereby effecting an adjustable flow of medium through the capillary slot, and an adjustable coat thickness.

10 Claims, 2 Drawing Sheets

DEVICE AND METHOD FOR COATING A FLAT SUBSTRATE

FIELD OF THE INVENTION

The invention is relative to a device for coating a flat substrate, with a coating module comprising a capillary slot which capillary slot is filled with a liquid coating medium and comprises an opening past which a surface of the substrate to be coated is to be conducted at a relatively small interval so that a coating layer is separated on said surface.

The invention is also relative to a method for coating a substrate, with a coating module past which the substrate with the surface to be coated is conducted, during which a coat of the coating medium is separated onto this surface, during which coating, a coating medium is supplied to the coating module.

BACKGROUND OF THE INVENTION

A device of the cited species is known in the state of the art from U.S. Pat. No. 5,650,196 and WO 94/25177. For example, rectangular or round plates can be provided with a uniform coat of lacquer or varnish or other media which are liquid at first such as color filters or special protective coats with this device. This device is used especially in the field of thin-layer technology in the production of LCD screen monitors, masks for semiconductor manufacture and semiconductor or ceramic substrates. This device is distinguished in particular by a high uniformity of the laquer layer density, especially on rectangular plates, while using a small amount of laquer at the same time. For coating, the substrate with the surface to be coated is conducted downward over the capillary slot, which is designed so that as a result of the capillarity of the slot the coating medium is supplied automatically and at an especially uniform rate. Such a capillary action is achieved, e.g., with a slot less than 0.5 mm wide. As a result of the capillary action the coating medium rises automatically upward against the force of gravity in the slot and exits at the opening of the capillary slot. The intermolecular binding forces, the surface tension and the particularities of the surface perfusing (wetting) are decisive for this method. Customary coating rates are approximately 5 to 15 mm/s. Since the volumetric flow is essentially determined by the intermolecular binding forces the coating rate can not be significantly raised.

SUMMARY OF THE INVENTION

The invention is based on the problem of creating a device of the cited species which makes possible a significantly higher coating rate but nevertheless assures a uniform coat thickness with a low consumption of material.

The invention is solved in a generic device in that the capillary slot is open at the bottom and is filled via a supply chamber with coating medium and that the substrate is conducted below the opening of the slot with the surface to be coated facing up. In the case of the device in accordance with the invention the volumetric flow through the capillary slot is not only determined by the intermolecular binding forces but can be actively fixed. As a result, significantly higher coating rates, e.g., between 30 and 100 mm/s, can be achieved. The higher coating rate accordingly makes possible a greater production and therewith a significant lowering of the manufacturing costs.

An especially reliable filing of the coating chamber results if, according to a further development of the invention, an overflow container is provided which communicates via a liquid line with the capillary slot and is arranged above the opening of the capillary slot. The overflow container is preferably mounted so that it can be adjusted in its height. The height of the overflow container is proportional to the flowthrough of medium through the capillary slot and therewith to the coat thickness.

If the coating module comprises, in accordance with a further development of the invention, two plates arranged parallel to one another and a foil arranged between the latter, different capillary slots can be produced in a simple manner. This makes it possible to apply coating media with different viscosities and also to produce different coat thicknesses via the variable feed rate of the substrate below the capillary. Said capillary slot can be determined in a simple manner by a cutout or notch of the foil. The two plates can be detachably screwed to one another, for example. In this instance a replacing of the foil in order to change the width of the capillary slot is especially simple.

In the method of the invention, a volumetric flow takes place from above downward through the capillary slot during the coating and the substrate with the surface to be coated facing up is moved past the capillary slot.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
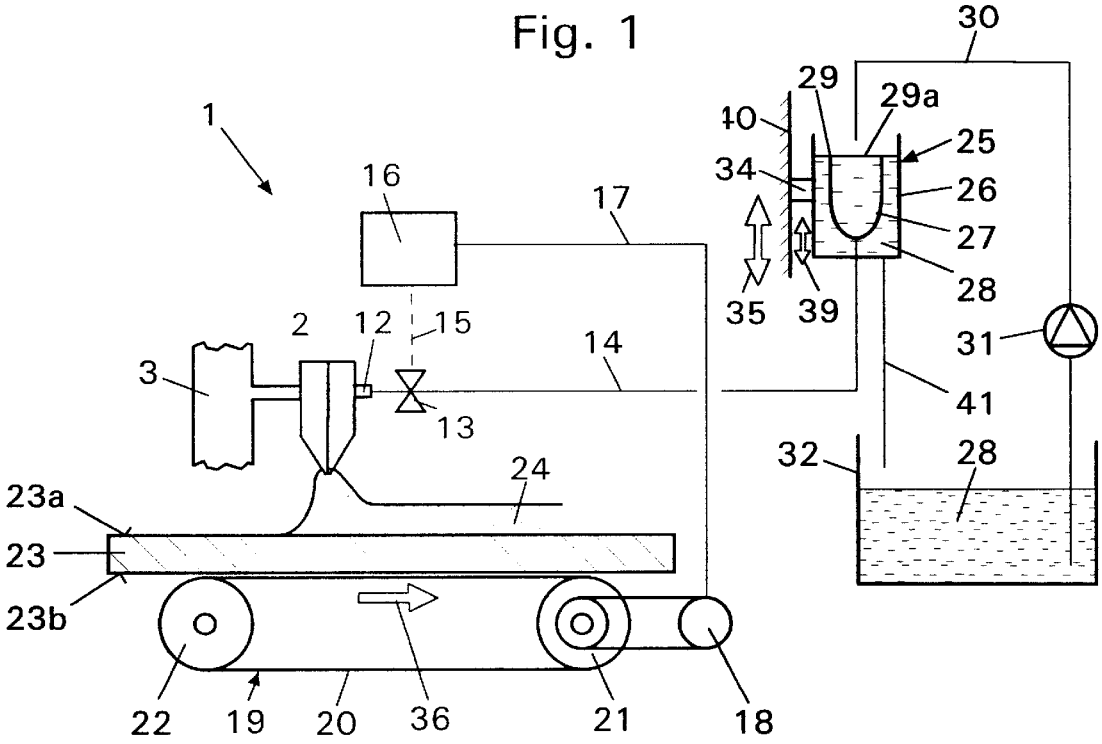
FIG. 1 shows a schematic view of a device in accordance with the invention.

Device 1 shown in FIG. 1 comprises a coating module 2 fastened to frame 3. Transport device 19 is arranged below coating module 2, with which device 19 a substrate 23 to be coated is conducted preferably horizontally past coating module 2 for coating an upper, flat surface 23*a*. Substrate 23 is in particular a plate or disk, e.g., a glass or ceramic plate. Coating module 2 communicates via liquid line 14 with overflow container 25 out of which coating medium 28 is supplied to coating module 2 during coating.

Figure 2:
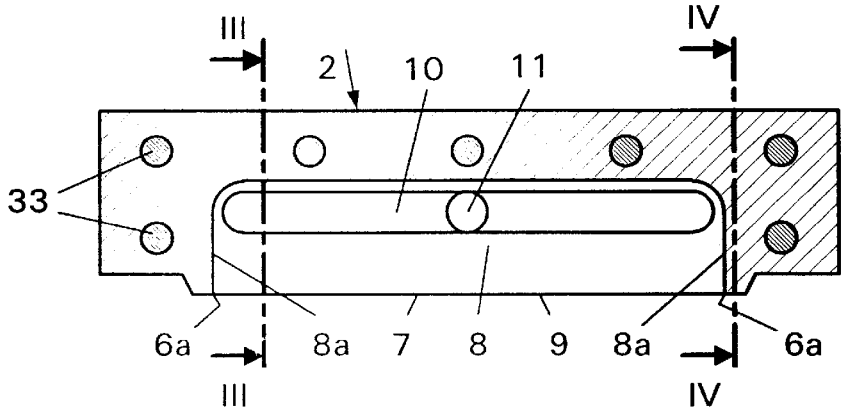
FIG. 2 shows a view of a coating module.
Figure 3:
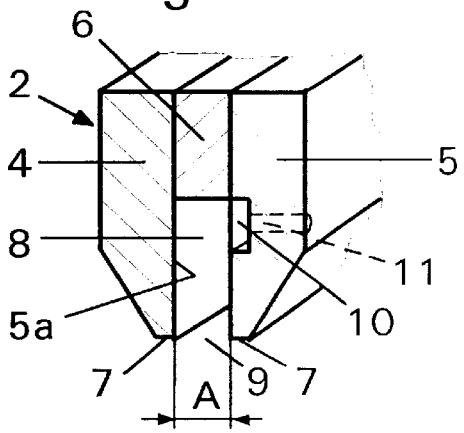
FIG. 3 shows a section through the coating module along line III—III.
Figure 4:
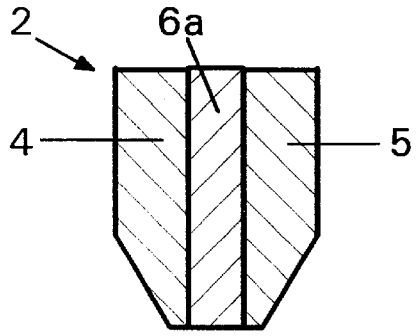
FIG. 4 shows a section through the coating module along line IV—IV.

According to FIGS. 2 and 3, coating module 2 comprises two plates 4, 5 arranged parallel to one another, between which foil 6 with a defined thickness is arranged. The two plates 4 and 5 consist, e.g., of glass or metal and are ground and polished in order to assure an appropriate surface quality. According to FIG. 2, foil 6 is provided with a cutout section 8*a* forming slot 8 which is essentially rectangular and closed at the sides and the top. Slot 8 comprises opening 9 at the bottom which opening exhibits a rectangular shape and is formed by parallel, comparatively sharp edges 7 of plates 4, 5 as well as by lateral edges 6*a* of foil 6. Width A of capillary slot 8 is in a range of 5 $\mu$m to a few millimeters. For example, a capillary slot 8 with a width A of 150 $\mu$m is suitable for applying a coat 2 $\mu$m thick. Coating medium 28 is applied in this instance with a temperature of approximately 20° C. and has a viscosity of approximately 7 $mPas^{-1}$.

The two plates 4, 5 are firmly screwed to one another with a plurality of fastening screws 33. Foil 6 is fixed by screws 33 in a firm and liquid-tight manner between plates 4, 5. After fastening screws 33 are loosened the foil can be taken out and replaced by another foil with a different thickness. Width A of capillary slot 8 can be readily changed by replacing foil 6. Foil 6 is preferably a plastic foil or metal foil. Such foils can be manufactured with a very small tolerance, e.g., with a deviation of thickness <1%. Width A of capillary slot 8 is precisely defined therewith but can be readily changed by replacing foil 6.

Conduit 10 is arranged on inner side 5*a* of plate 5, which conduit extends according to FIG. 2 over essentially the entire length of the capillary slot and which is located in the upper area of capillary slot 8. This conduit 10 is connected via bore 11 in plate 5 as well as via connection device 12 to liquid line 14. The flowthrough through line 14 can be varied with valve 13. Control device 16 is provided for control, which is connected to valve 13 via lead 15. Valve 13 is preferably pneumatically controlled. However, a control with a stepping stepper motor is also conceivable.

Line 14 communicates with overflow container 25, which is arranged above opening 9 of capillary slot 8. Overflow container 25 is attached to carrier 40 by a suitable adjustment device 34 in a height-adjustable manner. The height of overflow container 25 above opening 9 is in a range of 10 to 50 cm. The pressure of coating medium 28 in capillary slot 8 is proportional to the height of liquid level 29*a* above opening 9 of capillary slot 8. Thus, the pressure of coating liquid 28*a* in capillary slot 8 can be precisely adjusted by adjusting overflow container 25 in the directions of double arrow 39.

Overflow container comprises an outer container 26 as well as an inner container 27. lnner container 27 is connected at its lower end to liquid line 14 and comprises overflow edge 29 over which coating medium 28 can pass from inner container 27 into outer container 26. Liquid pump 31 delivers coating medium 28 from storage container 32 via liquid line 30 to overflow container 25. Excess coating medium 28 is returned via return line 41 from overflow container 25 to storage container 32. Liquid level 29*a* is therewith maintained constant independently of the height of overflow container 25 and also independently of the consumption of coating medium 28 during the coating. Correspondingly, it is assured therewith that the pressure of coating medium 28 is constant in capillary slot 8 during the coating process. Overflow container 25 could also be replaced by a feed screw, worm conveyor, or a pressure cylinder. It is essential that medium is supplied at a constant pressure with this device.

Transport device 19 comprises endless conveyor belt 20 placed around drive roller 21 and deflection roller 22. Drive roller 21 is driven by drive 18, e.g., an electromotor connected via signal lead 17 to control 16. Other transport devices are also conceivable here, e.g., a transport carriage or a transport device with rollers. Substrate 23 can be held on its underside 23*b* with suitable means (not illustrated), e.g. by a vacuum plate. Substrate 23 is transported as in FIG. 1 from left to right with transport device 19. The transport is preferably uniform and can be infinitely adjusted by means of control 16. Substrate 23 is preferably transported in a horizontal alignment, but an inclined alignment is also conceivable. Finally, an embodiment is also conceivable in which substrate 23 is not transported linearly but rather is rotated.

The individual method steps are explained in detail in the following.

Figure 5:
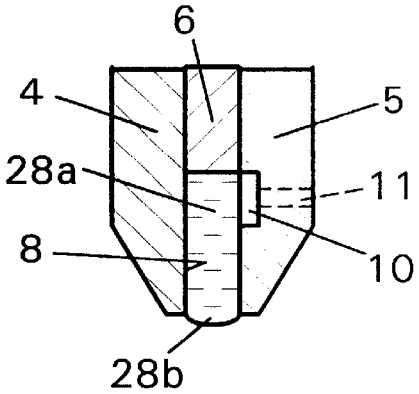
FIG. 5 shows a section through the coating module of FIG. 3 but with filled capillary slot.
Figure 6:
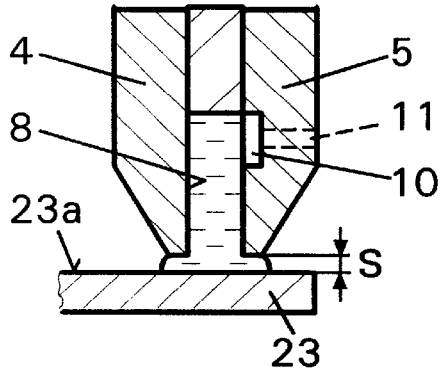
FIGS. 6 and 7 schematically show the coating of a flat substrate.

In order to fill capillary slot 8 with coating medium 28, coating medium 28 is transported by pump 31 out of storage container 32 into overflow container 25. From this container 25 the coating medium flows when valve 13 is open into capillary slot 8. The medium is held in capillary slot 8 by virtue of capillary forces, during which a meniscus 28*b* forms in accordance with FIG. 5. The pressure in liquid 28*a* is a function here in particular of the height of overflow container 25, the viscosity of coating medium 28 and of the temperature. Conduit 10 aids a uniform distribution of coating medium 28 over the entire length of capillary slot 8.

Figure 7:
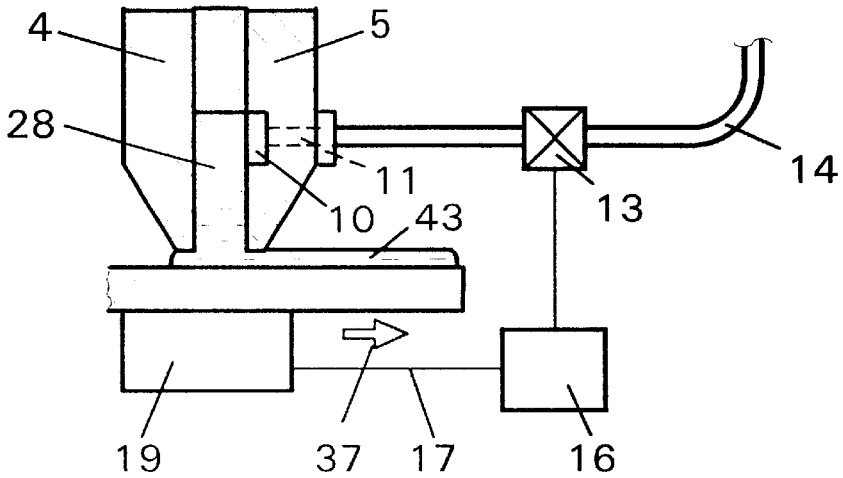

In order to coat substrate 23 it is conducted under opening 9 with surface 23*a* to be coated facing up and with valve 13 closed. While substrate 23 is standing still, valve 13 is opened, wherewith a uniform flowthrough of coating medium 28 is introduced through capillary slot 8. Slot S between surface 23*a* and edge 7 is now filled with substrate 23 and substrate 23 is perfused (wetted, or moistened). For the perfusing, substrate 23 is not transported for a period of approximately 0.1 to 1 second. Transport device 19 is subsequently activated and substrate 23 moved linearly from left to right at a constant speed in the direction of arrow 37 in FIG. 7. Since coating liquid 28 is constantly supplied at a steady pressure, as mentioned above, a uniform coat 43 forms on substrate 23, as FIG. 7 shows.

After the coating of substrate 23, valve 13 is closed again. The closing of valve 13 preferably takes place before the end of the substrate has been reached in such a manner that when the end of the substrate has been reached the supply of coating medium is interrupted in slot or area S and the coating medium can not flow over the edge of the end of the substrate. The suitable point in time for closing is in particular a function of the viscosity of medium 28 and can be optimized in the process. Device 1 is now ready again for a further coating. Applied coat 43 is dried in a known manner. The coat thickness after drying is, e.g., 2.5 to 3 $\mu$m.

The coat thickness is essentially determined by the viscosity and the solid content of coating medium 28 as well as by the height of overflow container 25 above opening 9, by width A of capillary slot 8 as well as by the rate of transport of substrate 23. The coat thickness of 2.5 to 3 $\mu$m mentioned above is obtained, e.g., with a coating medium 28 which has a solid content of 10% and a viscosity of approximately 5.5 $mPas^{-1}$. The temperature of coating medium 29 is 20° C. thereby and the height of overflow container 25 above surface 23*a* to be coated is 28 mm. Slot width A is 130 $\mu$m and the rate of transport 30 mm/s. In spite of the comparatively high rate of transport a good uniformity of coat 43 is achieved. The deviations in the thickness of coat 43 are as a rule less than 1%.

While specific embodiments of the invention have been shown and described in detail to illustrate the application of the principles of the invention, it will be understood that the invention may be embodied otherwise without departing from such principles.

What is the claimed is:

1. A method of coating a substrate, the method comprising:

supplying a liquid medium from a liquid medium supply device to a coating module including a slot;

passing a substrate to be coated underneath the slot of the coating module;

coating a surface of the substrate with the liquid medium via the slot of the coating module as the substrate passes underneath the slot; and adjusting a pressure of the liquid medium in the slot of the coating module by changing an elevation of the liquid medium supply device relative to the coating module in order to adjust a thickness of the liquid medium coated onto the substrate.

2. The method of claim 1, further comprising adjusting a width of the slot by replacing a foil located between first and second opposing plates of the coating module which define the slot.

3. The method of claim 1, further comprising:

opening a valve between the coating module and the liquid medium supply device when the substrate is stationary in order to initiate flow of the liquid medium from the supply device to the slot of the coating module, and after a predetermined period of time has passed since opening of the valve, initiating movement of the substrate in order to pass the substrate underneath the slot so that the substrate can be coated.

4. An apparatus for coating a substrate, the apparatus comprising:

a storage container or reservoir for holding a liquid coating medium;

a liquid medium supply device that receives liquid coating medium from the storage container or reservoir;

a coating module including an application slot that receives liquid coating medium from the liquid medium supply device, wherein said slot is open at a bottom thereof, such that when the substrate to be coated is moved beneath said slot, the surface of the substrate can be coated via said slot, and wherein the liquid medium supply device is located at an elevation above said coating module so that liquid medium is supplied from said liquid medium supply device to said coating module via a gravity feed;

wherein the elevation or height of said liquid medium supply device relative to said coating module is adjustable in order to vary a thickness of a layer of the liquid medium coating applied to the substrate via said slot; and wherein said liquid medium supply device includes an inner container for holding liquid medium, and an outer container at least partially surrounding the inner container for holding liquid medium which overflows from the inner container, wherein liquid medium from the inner container is forwarded to the coating module via the gravity feed and liquid medium from the outer container is forwarded back to said storage container or reservoir.

5. The apparatus of claim 4, wherein said slot defines a width that is adjustable, said width of said slot being adjustable by varying a thickness of a foil placed between first and second opposing plates defining said slot.

6. The apparatus of claim 4, wherein said slot is located at an elevation above a surface of the substrate to which the liquid medium is to be applied.

7. The apparatus of claim 4, further including a valve connected to a liquid medium supply line provided between said coating module and said inner container of said liquid medium supply device.

8. The apparatus of claim 4, wherein said coating module includes a foil sheet provided between first and second opposing plates, wherein said foil sheet spaces said plates from one another in order to define a width of said slot.

9. The apparatus of claim 8, wherein said foil sheet includes a cut-out section (8*a*) defined therein, said cut-out section being provided at an area where said slot is defined between said plates.

10. An apparatus for coating a substrate, the apparatus comprising:

a storage container or reservoir for holding a liquid coating medium;

a liquid medium supply means for receiving a liquid coating medium from the storage container or reservoir;

coating module means including an application slot for receiving liquid coating medium from the liquid medium supply means and for applying the coating to a substrate passing beneath the slot, wherein the liquid medium supply means is located at an elevation above said coating module means so that liquid medium is supplied from said liquid medium supply means to said coating module means via a gravity feed;

wherein the elevation or height of said liquid medium supply means relative to said coating module means is adjustable in order to vary a thickness of a layer of the liquid medium coating applied to the substrate via said slot; and wherein said liquid medium supply means includes an inner means for holding liquid medium, and an outer means at least partially surrounding the inner means for holding liquid medium which overflows from the inner means, wherein liquid medium from the inner means is forwarded to the coating module means via the gravity feed and liquid medium from the outer means is forwarded back to said storage container or reservoir.

* * * * *